US008080112B2

(12) United States Patent
Guillon

(10) Patent No.: US 8,080,112 B2
(45) Date of Patent: Dec. 20, 2011

(54) METHOD OF WASHING PIPEWORK

(75) Inventor: Pierre Guillon, Angers (FR)

(73) Assignee: Pack Realisations, Beaucouze (FR)

( * ) Notice: Subject to any disclaimer, the term of this patent is extended or adjusted under 35 U.S.C. 154(b) by 601 days.

(21) Appl. No.: 12/278,664

(22) PCT Filed: Feb. 8, 2007

(86) PCT No.: PCT/EP2007/001071
§ 371 (c)(1),
(2), (4) Date: Dec. 24, 2008

(87) PCT Pub. No.: WO2007/090641
PCT Pub. Date: Aug. 16, 2007

(65) Prior Publication Data

US 2010/0051061 A1 Mar. 4, 2010

(30) Foreign Application Priority Data

Feb. 10, 2006 (FR) ..... 06 01212

(51) Int. Cl.
*B08B 9/027* (2006.01)
*B08B 9/00* (2006.01)

(52) U.S. Cl. ..... 134/22.11; 134/22.12

(58) Field of Classification Search ..... 134/22.12, 134/26, 30, 34, 36
See application file for complete search history.

(56) References Cited

U.S. PATENT DOCUMENTS 3,513,024 A * 5/1970 Culliton ..... 134/22.18
4,024,896 A 5/1977 Ishioka

FOREIGN PATENT DOCUMENTS

FR 2140409 1/1973

OTHER PUBLICATIONS

International Search Report for PCT/EP2007/001071, mailed Jul. 9, 2007.

* cited by examiner

*Primary Examiner* — Michael Kornakov
*Assistant Examiner* — Arlyn I Rivera-Cordero
(74) *Attorney, Agent, or Firm* — Nixon & Vanderhye PC

(57) ABSTRACT

The invention concerns a method of washing pipework comprising a high point and at least one low point and filled with a liquid product, the washing method comprising:

a step of draining the pipework of the liquid product;

a step of filling the pipework with a washing product up to a filling level below the level of the high point;

a step of introducing into the pipework a total volume of air through the or each low point the total volume of air introduced being substantially equal to the volume existing between the level of the high point and the filling level; and a step of draining the pipework of the washing product;

the method being characterised in that the introduction step comprises at least two cycles, each cycle comprising in series an introduction of a volume of air of a first type at a first rate and an introduction of a volume of air of a second type at a second rate lower than the first rate.

5 Claims, 1 Drawing Sheet

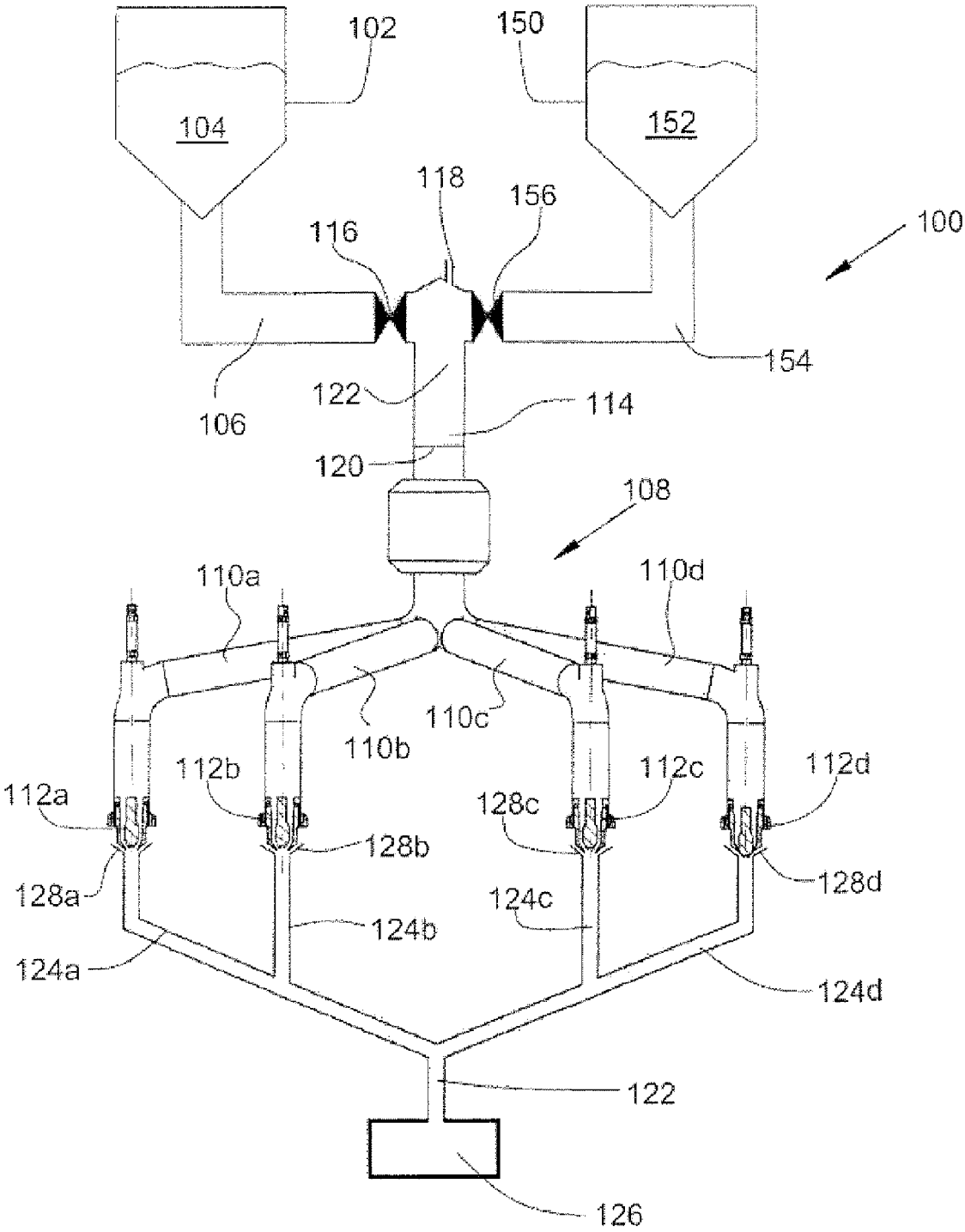
102
150
104
152
118
156
116
100
154
106
122
114
120
108
110a
110d
110c
110b
112b
112c
112d
112a
128c
128b
128d
128a
124c
124b
124a
124d
122
126

METHOD OF WASHING PIPEWORK

CROSS-REFERENCE TO RELATED APPLICATIONS

This application is the U.S. national phase of International Application No. PCT/EP2007/001071 filed 8 Feb. 2007 which designated the U.S. and claims priority to FR 0601212 filed 10 Feb. 2006, the entire contents of each of which are hereby incorporated by reference.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable.

INCORPORATION BY REFERENCE OF MATERIAL SUBMITTED ON A COMPACT DISK

Not applicable.

BACKGROUND OF THE INVENTION

1. Field of the Invention

The present invention concerns a method of washing pipework of a filling machine or similar device.

2. Description of Related Art Including Information Disclosed Under 37 C.F.R. 1.97 and 1.98

A filling machine is a device that automatically fills bottles or cans with a liquid product.

Such a filling machine 100 is shown in the single FIGURE. It comprises a first reservoir 102 in which a first liquid product 104 is stored and a second reservoir 150 in which a second liquid product 152 is stored.

The first liquid product 104 flows from the first reservoir 102 through a first connecting pipe 106 as far as a feed pipe 114 passing through a first valve 116. The second liquid product 152 flows from the second reservoir 150 through a second connecting pipe 154 as far as the feed pipe 114 passing through a second valve 156. The first valve 116 and the second valve 156 are disposed at the feed pipe 114 and are controlled so that only one is open to allow the passage of only one liquid product 104 or 152 or so that neither is open so as to allow the washing of the pipework of the filling machine 100, as explained below.

From the feed pipe 114, the liquid product 104, 152 flows as far as a distributor 108. From this distributor 108, several filling pipes 110*a*, 110*b*, 110*c* and 110*d* extend, which are distributed so as to allow the simultaneous filling of several cans. Each filling pipe 110*a*, 110*b*, 110*c*, 110*d* terminates in a filling nozzle 112*a*, 112*b*, 112*c*, 112*d* through which the liquid product 104 flows into the can. Each filling nozzle 112*a*, 112*b*, 112*c*, 112*d* comprises an opening and closing device controlled by a control unit.

When the first liquid product 104 is to be replaced by the second liquid product 152, the first reservoir 102 must be disconnected from the feed pipe 114 by closing the first valve 116, and then the filling machine 100, and in particular the pipework extending between the feed pipe 114, the distributor 108, the filling pipes 110*a*, 110*b*, 110*c* and 110*d* and the filling nozzles 112*a*, 112*b*, 112*c* and 112*d*, must be washed in order to make all traces of the first liquid product 104 disappear before the second reservoir 152 is connected to the feed pipe 114 by opening the second valve 156.

A method of washing the pipework of the filling machine 100 is known which comprises a step of draining the first liquid product 104 through the filling nozzles 112*a*, 112*b*, 112*c*, and 112*d*, a step of filling the pipework of the filling machine 100 with a washing liquid and a step of draining the washing liquid. The step of filling with the washing liquid and the step of draining the washing liquid can be repeated several times according to the degree to which the pipework of the filling machine 100 is dirty. This method requires a large quantity of washing liquid and, according to the number of passes of this washing liquid, the washing process may be lengthy.

Another washing method is known that comprises, after closure of the first valve 116, a step of draining the pipework of the first liquid product 104 through the filling nozzles 112*a*, 112*b*, 112*c* and 112*d*, a step of filling the pipework of the filling machine 100 with a washing liquid up to a filling level referenced 120, a step of introducing at a constant rate into the pipework a volume of air through the filling nozzles 112*a*, 112*b*, 112*c* and 112*d* and a step of draining the washing liquid.

The filling step consists of filling the pipework of the filling machine 100, that is to say the filling nozzles 112*a*, 112*b*, 112*c* and 112*d*, the filling pipes 110*a*, 110*b*, 110*c* and 110*d*, the distributor 108 and the feed pipe 114 with the washing product. Filling up to the filling level 120 thus leaves free an expansion volume 122 that does not contain any washing liquid. The volume of air introduced corresponds substantially to this expansion volume 122 and the top of the feed pipe 114 is provided with a vent 118 that allows discharge of the air from the expansion volume 122. The introduction of the air at a constant rate into the washing liquid causes the latter to rise in the pipework of the filling machine 100 and in particular in the feed pipe 114. The washing liquid then fills all the feed pipe 114 through discharge of the air initially contained in the expansion volume 122 through the vent 118. The air introduced rises by the effect of Archimedes' law then in the various pipes 110*a*, 110*b*, 110*c*, 110*d*, 108 and 114 so as to discharge through the vent 118. When the volume of air rises, the washing liquid situated just above the volume of air descends just below the volume of air, which generates a to and fro movement assisting the detachment of the particles of the first liquid product 104 stuck to the walls of the pipework.

The introduction of the volume of air takes place in one go, the introduction rate and the volume of air must be determined so that the washing liquid reaches as far as the vent 118 but without overflowing. This is because an excessively violent introduction of a volume of air corresponding to the expansion volume 122 causes a rising of the washing liquid as far as the top of the feed pipe 114 but, under the effect of its inertia, the washing liquid rises higher and overflows from the feed pipe 114 through the vent 118.

Even if this washing method gives good results, it keeps certain drawbacks. For example, during this washing method, the introduction of the air generates a single to and fro movement, which may not be sufficient to detach certain particles of the first liquid product 104, which then remain fixed to the walls of the pipework. This is because the washing is all the more effective when there are several to and fro movements and the speed of introduction of the volume of air is great. Because the introduction of the volume of air takes place at a low speed, the air introduced moves in the form of bubbles and the washing process is more similar to a process of stirring the washing liquid than to a true washing method.

BRIEF SUMMARY OF THE INVENTION

One object of the present invention is to propose a method of washing pipework that does not have the drawbacks of the prior art while allowing better washing of the pipework.

To this end, there is proposed a method of washing pipework comprising a high point and at least one low point, and filled with a liquid product, the washing method comprising:

a step of draining the pipework of the liquid product;

a step of filling the pipework with a washing product up to a filling level below the level of the high point;

a step of introducing into the pipework a total volume of air through the or each low point, the total volume of air introduced being substantially equal to the volume existing between the level of the high point and the filling level; and a step of draining the pipework of the washing product;

the method being characterised in that the introduction step comprises at least two cycles, each cycle comprising in series an introduction of a volume of air of a first type at a first rate and an introduction of a volume of air of a second type at a second rate lower than the first rate, and in that the interval of time between the introduction of the first volume of air of the first type and the introduction of the last volume of air of the first type is less than the interval of time necessary for the first volume of air of the first type to reach the high point.

Advantageously, the second rate is zero.

According to a particular embodiment, when there are several low points, the starting of the cycle of one of the low points takes place sequentially with respect to the other low points.

According to another particular embodiment, when there are several low points, the starting of each cycle takes place simultaneously in each of the low points.

Advantageously, the first rate is such that the introduction of the volume of air of the first type generates a bubble filling the section of the pipework.

The characteristics of the invention mentioned above, as well as others, will emerge more clearly from a reading of the following description of an example embodiment, the said description being given in relation to the single FIGURE, which depicts a filling machine.

The elements identical to the filling machine 100 of the prior art bear the same references.

BRIEF DESCRIPTION OF THE DRAWING

The single FIGURE is a schematic view in elevation of a filling machine for automatically filling bottles or cans with a liquid product.

DETAILED DESCRIPTION OF THE INVENTION

The filling machine 100 comprises a reservoir of air under pressure 126 that supplies a main pipe 122 from which the secondary pipes 124*a*, 124*b*, 124*c* and 124*d* are supplied. Each secondary pipe 124*a*, 124*b*, 124*c* and 124*d* terminates in a connection nozzle 128*a*, 128*b*, 128*c*, 128*d*. Each connection nozzle 128*a*, 128*b*, 128*c*, 128*d* fits sealingly on one of the filling nozzles 112*a*, 112*b*, 112*c* and 112*d* so that, when the filling nozzles 112*a*, 112*b*, 112*c* and 112*d* are open, the air pressurised by the pressurised air reservoir 126 enters through each of the filling nozzles 112*a*, 112*b*, 112*c* and 112*d*.

In another embodiment, each filling nozzle 112*a*, 112*b*, 112*c*, 112*d* is provided with an injector through which the pressurised air is injected.

The pipework of the filling machine 100 extends between a high point here taking the form of the vent 118 and at least one low point, each of them here taking the form of a filling nozzle 112*a*, 112*b*, 112*c*, 112*d*.

According to the invention, the method of washing the pipework 100 that is filled with liquid product 104 comprises:

a step of draining the pipework of the liquid product 104;

a step of filling the pipework with a washing product up to a filling level 120 below the level of the high point 118;

a step of introducing into the pipework a total volume of air through the or each low point 112*a*, 112*b*, 112*c*, 112*d*, the total volume of air thus introduced being substantially equal to the volume existing between the level of the high point 118 and the filling level 120; and a step of draining the pipework of the washing product.

In the embodiment of the invention, the introduction step comprises at least two cycles, each cycle comprising in series an introduction of a volume of air of a first type at a first rate and an introduction of a volume of air of a second type at a second rate lower than the first rate, and the interval of time between the introduction of the first volume of air of the first type and the introduction of the last volume of air of the first type is less than the interval of time necessary for the first volume of air of the first type to reach the high point 118.

The succession of at least two cycles thus generates at least one volume of air of the first type and one volume of air of the second type and then, once again, a volume of air of the first type. This succession of volumes of air produced by the introduction of air at different rates generates variations in the speed of the washing liquid towards the high point 118 and these variations in speed promote the detachment of the particles of the first liquid product 104. Each volume of air of the first type thus generates a shock that echoes along the pipework and that detaches the particles of the first liquid product 104.

In an embodiment, the second rate is very low or even zero. In this case, the total volume of air takes the form of two volumes of air of the first type that follow each other at a certain distance from each other and that are separated by a volume of washing liquid containing little or no air. This succession makes it possible to obtain a plurality of to and fro movements while guaranteeing that the top of the pipework is washed, and this in a very short time.

This is because, for each volume of air of the first type introduced, the column of washing liquid undergoes an ascending movement towards the high point 118 and, at each passage of a volume of air of the first type, the washing liquid undergoes a descent movement. There is therefore indeed a succession of to and fro movements.

In the case of the washing method of the prior art, the volume of air introduced on a single occasion is substantially equal to the expansion volume 122 and if, in order to improve the washing, a second introduction is necessary, a person skilled in the art will wait until the first volume of air is discharged through the high point 118 before carrying out the second injection, without which the washing liquid will overflow through the high point 118. The duration of the washing method according to the invention is therefore very much less than that of the washing method of the prior art.

The fact that the interval of time between the introduction of the first volume of air of the first type and the introduction of the last volume of air of the first type is less than the interval of time necessary for the first volume of air of the first type to reach the high point 118 guarantees that the expansion volume 122 is entirely washed before the first volume of air reaches the high point 118 and leaves the pipework.

When there are several low points 112*a*, 112*b*, 112*c* and 112*d*, it is possible for the starting of the cycle of one of the low points 112*a*, 112*b*, 112*c*, 112*d* to take place sequentially with respect to the other low points 112*a*, 112*b*, 112*c*, 112*d* or for the starting of each cycle to take place simultaneously in each of the low points 112*a*, 112*b*, 112*c*, 112*d*.

In order to guarantee good washing of the pipework, it is preferable for each volume of air introduced to remain in the form of single volume and not to disperse in the form of air bubbles. Preferably, the first rate is such that each volume of air of the first type consists of a single bubble or a set of bubbles filling the section of the pipework. A high introduction rate also guarantees a rapid rise in the washing liquid and the washing is all the better, the higher the rising speed of the washing product.

The pipework thus comprises a high point 118 and at least one low point 112*a*, 112*b*, 112*c*, 112*d* and is filled with the liquid product 104, the pipework also comprises:

means of draining the liquid product 104;

means of filling with a liquid product up to the filling level 102 lower than the level of the high point 118;

means of introducing the total volume of air through the or each low point 112*a*, 112*b*, 112*c*, 12*d*, the total volume of air introduced being substantially equal to the volume existing between the level of the high point 118 and the filling level 120; and means of draining the washing product.

To allow the implementation of the washing method described above, the introduction means comprise regulation means provided for effecting at least two cycles, each cycle comprising in series an introduction of a volume of air of the first type at a first rate and an introduction of a volume of air of the second type at a second rate lower than the first rate and the interval of time between the introduction of the first volume of air of the first type and the introduction of the last volume of air of the first type is less than the interval of time necessary for the first volume of air of the first type to reach the high point 118. As explained above, the second rate can be low or even zero.

The drainage means here take the form of filling nozzles 112*a*, 112*b*, 112*c*, 112*d* and the filling means can take the form of a filling pipe connected to the feed pipe 114 by means of a third valve.

The regulation means comprise air introduction devices and a control unit controlling each air introduction device. According to the characteristics of the filling pipework, the user determines the volume and rate of each volume of air of the first type or of the second type to be introduced as well as the interval of time between each of them. These various data are recorded in the control unit, which can then control the air introduction devices according to these various data.

In the embodiment of the invention depicted in the single FIGURE, the air introduction devices consist of connection nozzles 128*a*, 128*b*, 128*c* and 128*d*, each of them being adapted to fit sealingly on one of the low points 112*a*, 112*b*, 112*c*, 112*d*.

In another embodiment, the air introduction devices can consist of injectors, each of them being placed at one of the low points 112*a*, 112*b*, 112*c*, 112*d*.

In the case of the filling machine 100, each low point 112*a*, 112*b*, 112*c*, 112*d* is a filling nozzle for filling a can.

Because of the cohesion of each volume of air introduced, the pipework can consist of horizontal and/or vertical portions.

Naturally the present invention is not limited to the example and embodiment described and depicted but is capable of many variants accessible to persons skilled in the art.

In the embodiment described, each volume of the first type is introduced at a first rate and each volume of the second type is introduced at a second rate, but it is possible, for each volume of the first type, for the rate to be different or, for each volume of the second type, for the rate to be different.

The invention claimed is:

1. Method of washing pipework comprising a high point (118) and at least one low point (112*a*, 112*b*, 112*c*, 112*d*) and filled with a liquid product (104), the washing method comprising:

a step of draining the pipework of the liquid product (104);

a step of filling the pipework with a washing product up to a filling level (120) below the level of the high point (118);

a step of introducing into the pipework a total volume of air through the or each low point (112*a*, 112*b*, 112*c*, 112*d*) the total volume of air introduced being substantially equal to the volume existing between the level of the high point (118) and the filling level (120); and a step of draining the pipework of the washing product;

the method being characterised in that the introduction step comprises at least two cycles, each cycle comprising in series an introduction of a volume of air of a first type at a first rate and an introduction of a volume of air of a second type at a second rate lower than the first rate, and in that the interval of time between the introduction of the first volume of air of the first type and the introduction of the last volume of air of the first type is less than the interval of time necessary for the first volume of air of the first type to reach the high point (118).

2. Method of washing pipework according to claim 1, characterised in that the second rate is zero.

3. Method of washing pipework according to claim 1, characterised in that, when there are several low points (112*a*, 112*b*, 122*c*, 112*d*), the starting of the cycle of one of the low points (112*a*, 112*b*, 122*c*, 112*d*) takes place sequentially with respect to the other low points (112*a*, 112*b*, 112*c*, 112*d*).

4. Method of washing pipework according to claim 1, characterised in that, when there are several low points (112*a*, 112*b*, 112*c*, 112*d*), the starting of each cycle takes place simultaneously in each of the low points (112*a*, 112*b*, 112*c*, 112*d*).

5. Method of washing pipework according to claim 1, characterised in that the first rate is such that the introduction of the volume of air of the first type generates a bubble filling the section of the pipework.

* * * * *